United States Patent [19]

Watanabe

[11] Patent Number: 4,800,929

[45] Date of Patent: Jan. 31, 1989

[54] WEBBING FOR SAFETY BELT

[75] Inventor: Masao Watanabe, Shizuoka, Japan

[73] Assignee: Nippon Seiko Kabushiki Kaisha, Tokyo, Japan

[21] Appl. No.: 18,396

[22] Filed: Feb. 25, 1987

[30] Foreign Application Priority Data

Feb. 28, 1986 [JP] Japan ..... 61-27445[U]

[51] Int. Cl.[4] ..... P03D 5/00

[52] U.S. Cl. ..... 139/383 R; 428/193

[58] Field of Search ..... 139/383 R, 384 R, 420 R, 139/425 R; 428/192, 193 X, 257, 258

[56] References Cited

U.S. PATENT DOCUMENTS

| | | | |
|---|---|---|---|
| 2,672,168 | 3/1954 | Walters | 139/383 R |
| 2,800,927 | 7/1957 | Silberman et al. | 139/383 |
| 4,018,960 | 4/1977 | Berger et al. | 428/193 |
| 4,148,957 | 4/1979 | Berger et al. | 428/193 |
| 4,174,738 | 11/1979 | Berger et al. | 139/384 R |
| 4,202,381 | 5/1980 | Bucher | 139/383 R |
| 4,502,513 | 5/1985 | Müeller | 139/383 R |
| 4,600,626 | 7/1986 | Ogata | 428/193 |
| 4,660,605 | 4/1987 | Koch | 139/420 R |

*Primary Examiner*—Henry S. Jaudon

*Attorney, Agent, or Firm*—Wegner & Bretschneider

[57] ABSTRACT

A webbing for a safety belt includes a main part and selvedges extending along both sides of the main part. The denier size of warp threads in at least one of the selvedges is smaller than the denier size of warp threads in the main part and decreases stepwise toward the outermost warp thread in the selvedge. The outermost warp thread has a denier size either equal to or smaller than the denier size of weft threads. The weft threads are made of threads having a higher heat shrinkage percentage than the warp threads in the main part.

10 Claims, 3 Drawing Sheets

WEBBING FOR SAFETY BELT

BACKGROUND OF THE INVENTION

1. Field of the Invention

This invention relates to a webbing for safety belts which serve to protect passengers in airplane accidents, vehicle accidents or like accidents.

2. Description of the Prior Art

Most of webbings for safety belts (hereinafter called simply "webbings" for the sake of brevity) are produced by needle looms these days. In each of such webbings, one of the selvedges is formed as a knitted selvedge and the other selvedges takes the form of a woven selvedge. As warp threads for these selvedges, the same threads as the warp threads of its main part, namely, threads having a relatively large denier size are used.

Due to the use of such large-diameter warp threads, the outer edge of the knitted selvedge tends to become uneven in the lateral direction to an extent as much as the diameter of at least one warp thread. In order to align outwardly-extending end loops of weft threads, it has been necessary to use an intertwining thread also known as a catch thread, of a relatively large denier size (250–500 denier). Another problem has however arisen from the use of such an intertwining thread that the end loops become unavoidably large.

Similarly, the woven selvedge presents an uneven outer edge because the turning points of weft threads vary in and out in the widthwise direction to an extent as much as the diameter of at least one warp thread. An additional problem is also involved that the weft threads project out from the warp threads due to the tensile force of the warp threads since the warp threads have a large denier size. (see, FIG. 6 in which a indicates warp threads and b denotes weft threads.).

For the above-mentioned reasons, the knitted selvedge and woven selvedge are thus accompanied by such inconvenience that while wearing the webbing, the manner of their contact to clothing is unpleasant and the feeling of their touch to the skin is hard especially in light dress.

As a solution for the above problems, there has been proposed a webbing in which at least one of the selvedges has a tubular shape and uses threads having a higher elongation than those of the main part of the webbing (see, U.S. Pat. No. 4,018,960 issued Apr. 19, 1977 to Johann Berger et al.).

In the above-proposed webbing, the warp threads of the selvedges are subjected to advance shrinkage or the denier size of the warp threads of the selvedges is either increased or reduced by employing twisted threads, so that the cutting of the main part and selvedges of the webbing can be effected simultaneously. Extreme difficulties are however encountered in the fabrication of the webbing, because not only the adjustment of elongation but also various other conditions such as weave and weaving conditions are correlated as a matter of fact.

Although the above-proposed webbing gives superior feeling to touch to conventional webbings, it is still accompanied by the following problems. The selvedges are in a tubular form and are each composed of two plies, one being a front ply and the other a back ply. When the webbing is bent by a guide, the front ply is stretched while the back ply in contact with a guide undergoes buckling. As a result, the warp threads of the back ply are loosened and are hence rendered susceptible to abrasion. In an earlier stage of its use, the back ply tends to develop fluffing due to cutting of its filaments, resulting in such problems that the appearance of the webbing is impaired, the user feels uneasy about the safety of the webbing and the smooth winding of the webbing into the associated retractor is disturbed.

With a view toward reducing the above problems, it has also been proposed to form the main part into a 4-up/4-down weave and to increase the density of weft threads in the selvedges. This proposal however involves such problems that the webbing becomes thicker, the associated retractor can take up the webbing over a shorter length thereof, and the fabrication cost of the webbing increases substantially.

SUMMARY OF THE INVENTION

An object of this invention is therefore to provide a webbing having soft-touch selvedges although it is substantially comparable in fabrication cost, fabrication readiness, abrasion resistance and the like with conventional webbings.

In one aspect of this invention, there is thus provided a webbing for a safety belt. The webbing comprises a main part and selvedges extending along both sides of the main part. The denier size of warp threads in at least one of the selvedges is smaller than the denier size of warp threads in the main part and decreases stepwise toward the outermost warp thread in said at least one selvedge. The outermost warp thread has a denier size at most equal to the denier size of weft threads. The weft threads are made of threads having a higher heat shrinkage percentage than the warp threads in the main part.

The present invention has brought about numerous advantages. For example, the webbing of this invention can be fabricated under the same fabrication conditions as conventional webbings by means of fabrication facilities for such conventional webbings because the webbing of the present invention is designed to give better feeling to touch during its use by the combination of the particular thread denier size and the specific physical properties of the threads. The webbing of this invention undergoes little fluffing even when used over an extended period of time. The webbing can therefore be smoothly taken up in a retractor so that neither uneasy nor unpleasant feeling is given to its wearer.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
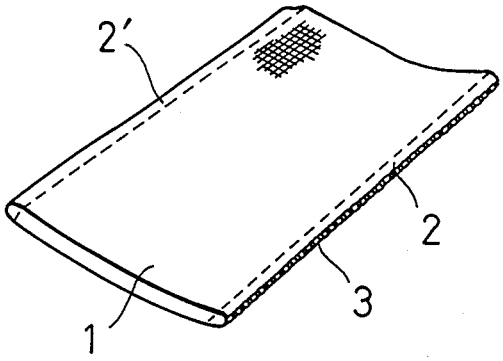
FIG. 1 is a fragmentary perspective view of a webbing according to one embodiment of this invention.
Figure 2:
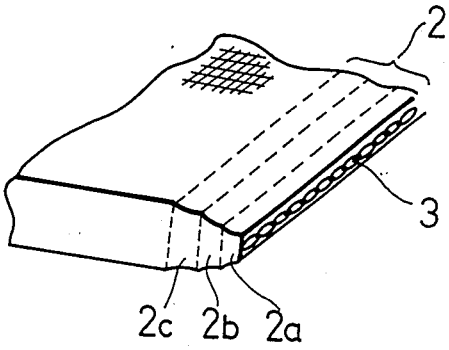
FIG. 2 is an enlarged fragmentary perspective view of a knitted selvedge of the webbing.

Referring now to FIGS. 1 and 2, there are shown a main part 1, a knitted selvedge 2, a woven selvedge 2' and loops 3.

The main part 1 has been constructed to satisfy various properties required for usual webbings, namely, the tensile strength, energy absorptivity, abrasion resistance and the like.

For the warp threads 14,15,16,17 in the main part 1, threads having a relatively large size of 1,000 denier–1,500 denier are used. The denier size of the filaments of the warp threads may preferably be 8–14 denier. If the filaments are thinner than 8 denier, more cut-off of filaments may be induced. If the filaments have a denier size greater than 14 denier on the other hand, the selvedge 3 becomes harder and may impair the feeling to the touch upon its contact with the body and clothing of the man under protection. A 2-up/2-down herringbone twill weave is adopted as the weave of the main part 1. Similar 2-up/2-down, 3-up/3-down and 4-up/4-down weaves may also be employed.

In the knitted selvedge 2, warp threads 2*a*–2*c* become finer toward the outermost warp thread 2*a* as depicted in FIG. 2. In the case of weft threads of 500 denier for instance, 750-denier threads, 500-denier threads and 250-denier threads are used as the warp threads 2*c*, warp threads 2*b* and warp threads 2*a* respectively. High-elongation and low-shrink threads, the elongation and heat shrinkage percentage of which are either equal to or greater than those of the warp threads in the main part 1, are used as the warp threads 2*a*–2*c*. Threads made of filaments, each of 8–14 denier, are employed. Unless a desired denier size is achieved, threads of 250 denier may be combined or twisted together into combined or twisted threads having the desired denier size. It is desirable to use twisted threads for the outermost selvedge threads from the viewpoint of abrasion resistance.

Figure 3:
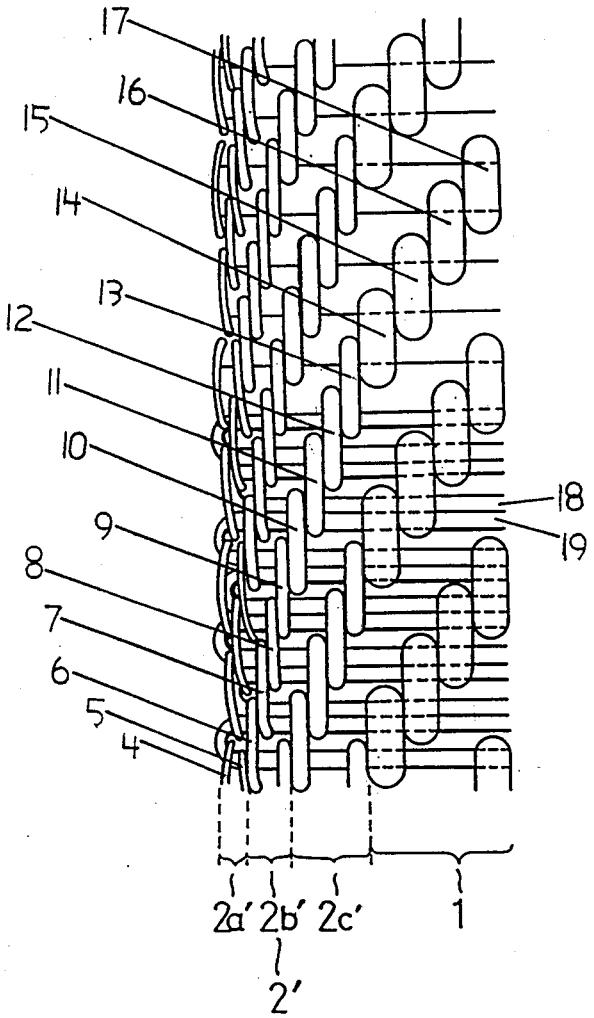
FIG. 3 is a fragmentary schematic plan view of a woven selvedge of the webbing.
Figure 6:
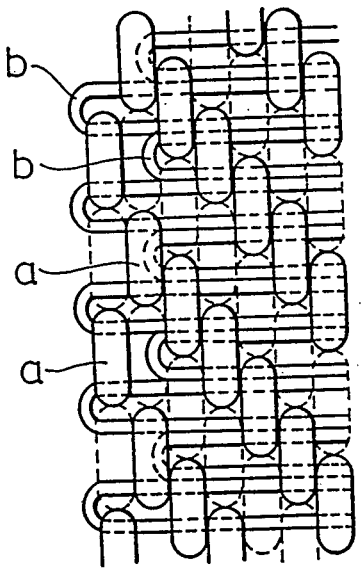
FIG. 6 is a fragmentary schematic plan view of a woven selvedge of a conventional webbing as described at page 2, lines 5–14, supra).

Warp threads 2*a*'2*c*' of the woven selvedge 2' also become finer toward the outermost warp thread 2*a*' (see, FIG. 3). In FIG. 3, threads 4–13 are warp threads of selvedge 2'. The warp threads and weft threads 18,19 are woven together. Warp threads 4,5 form selvedge 2*a*', warp threads 6,7,8,9 form selvedge 2*b*', and warp threads 10,11,12,13 form selvedge 2*c*'. Their elongation and heat shrinkage percentage are similar to those of the warp threads 2*a*–2*c* of the knitted selvedge 2. Namely, high-elongation and low-shrink threads, the elongation and heat shrinkage percentage of which are either equal to or greater than those of the warp threads in the main part 1, are used as the warp threads 2*a*'–2*c*'.

In view of the stability of tensile strength, seam strength and the like, threads having a denier size in a range of 500 denier–750 denier are used as weft threads. Namely, the denier size of the weft threads is either equal to or larger than that of the warp threads 2*a*–2*c* in the knitted selvedge 2 and the warp threads 2*a*'–2*c*' in the woven selvedge 2'. From the standpoint of feeling of the selvedges to contact, finer threads are preferable. Threads having a high heat shrinkage percentage are used as the weft threads.

On the other hand, a thread having a high heat shrinkage percentage and a possible smallest denier size still capable of retaining fraying-stopping function is used as a intertwining (or catch) thread, so that the loops 3 have the smallest size in the knitted selvedge 2.

According to the illustrated embodiment, the loops 3 are formed small in the knitted selvedge 2 as illustrated in FIG. 2. As shown in FIG. 3, the warp threads 2*a*'–2*c*' are shrunk in the woven selvedge 2' so that the warp threads 2*a*'–2*c*' do not protrude from the outer edge of the woven selvedge 2'. As a result, the loops 3 and warp threads 2*a*'–2*c*' are substantially free from indentation or jagging.

The above embodiment will next be described more specifically by the following Examples.

EXAMPLE 1

After fabrication of a gray cloth from the below-described threads in accordance with weaves which will also be described subsequently, its dyeing and finishing were carried out by means of a continuous dyeing machine to obtain a webbing having a thickness of 1.2 mm and a width of 49 mm. The loops of the knitted selvedge of the webbing were smaller compared with the corresponding loops of conventional webbings and were formed in close contact with the associated warp threads. Further, the turned end portions of the weft threads in the woven selvedge were inserted in the selvedge threads were hence not indented or jagged. Both selvedges gave good feeling to the touch. Test results on various properties thereof fully satisfied their corresponding values specified in the Japan Industrial Standards. After its abrasion resistance test, almost no fluffing was externally observed in each of the selvedges.

SPECIFICATION

Thread type

Warp threads (main part):
- 276 polyester threads, each of 1260 denier and 108 filaments.
  - Type A/1 (twisted).

Warp threads (selvedges):
- (a) 8 polyester threads, each of 250 denier and 24 filaments.
  - Type B/1 (twisted).
- (b) 8 polyester threads, each of 250 denier and 24 filaments.
  - Type B/2 (twisted).
  - equivalent to 500 denier.
- (c) 8 polyester threads, each of 250 denier and 24 filaments.
  - Type B/3 (non-twisted).
  - equivalent to 750 denier.

Weft threads:
- Polyester threads, each of 500 denier and 48 filaments.
  - Type C/1 (non-twisted).
  - 8 picks/cm.

Intertwining (or catch) thread:
- 1 polyester thread, 100 denier and 18 filaments.
  - Type D/1 (non-twisted).

Type B had a higher elongation and a smaller heat shrinkage percentage than Type C, whereas Types C and D had greater heat shrinkage percentages than Type A.

Weave:

Main part: 2-up/2-down herringbone twill weave, 3 rows.

Selvedges: 2-up/2-down twill weave.

Figure 4:
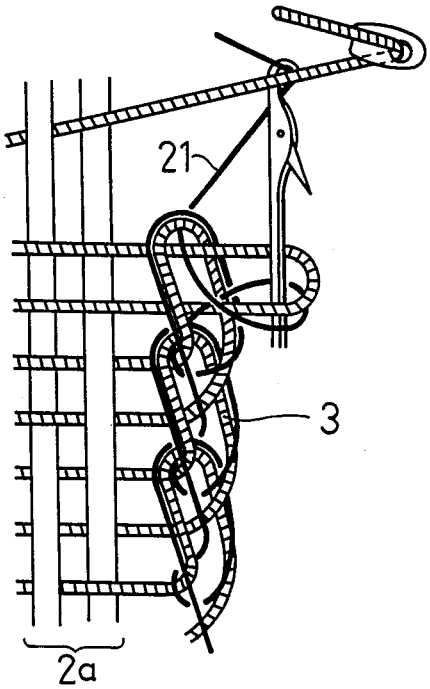
FIG. 4 is a weave pattern of the knitted selvedge (the weave shown in FIG. 5 is similar to the weave taught in U.S. Pat. No. 4,202,381)

Type of knitted selvedge:

The loops 3 were formed with the weft threads. Upon formation of the loop 3, the intertwining (or catch) thread 21 was interknitted simultaneously so as to reinforce as a fraying stopper, thereby forming the knitted selvedge (see, FIG. 4).

EXAMPLE 2

After fabrication of a gray cloth from the below-described threads in accordance with weaves which will also be described subsequently, its dyeing and finishing were carried out by a continuous dyeing machine in the same manner as in Example 1 to obtain a webbing having a thickness of 1.2 mm and a width of 49 mm. The webbing exhibited the same advantageous effects as the webbing of Example 1. In addition, the loops were formed very small since a thread having a denier size of 250 denier was used as a loop thread.

SPECIFICATION

Thread type

Warp threads (main part):

276 polyester threads, each of 1260 denier and 108 filaments.

Type A/1 (twisted).

Warp threads (selvedges):

(a) 12 polyester threads, each of 250 denier and 24 filaments.

Type B/1 (twisted).

(b) 12 polyester threads, each of 500 denier and 48 filaments.

Type C/1 (twisted).

Weft threads:

Polyester threads, each of 250 denier and 24 filaments.

Type D/2 (non-twisted).

8 picks/cm.

Loop thread (knitted selvedge thread):

1 polyester thread, 250 denier and 24 filaments.

Type D/1 (non-twisted).

Intertwining (or catch) thread:

1 polyester thread, 100 denier and 18 filaments.

Type E/1 (non-twisted).

Types B and C had higher elongations and smaller heat shrinkage percentages than Type A, whereas Types D and E had greater heat shrinkage percentages than Type A.

Main part: 2-up/2-down herringbone twill weave, 3 rows.

Selvedges: 2-up/2-down twill weave.

Figure 5:
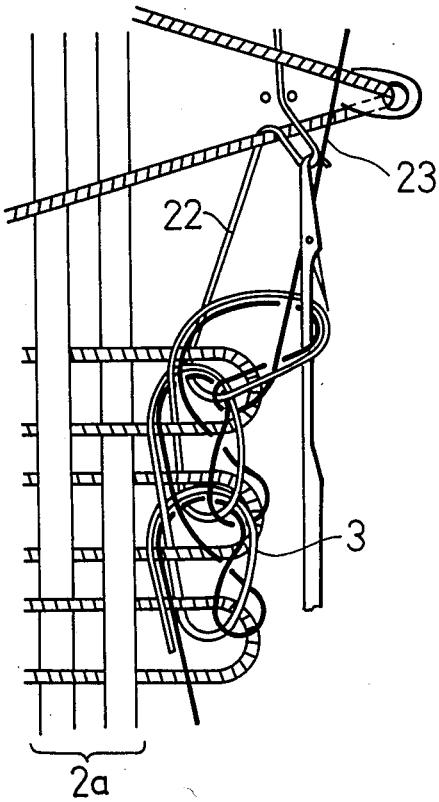
FIG. 5 is a weave pattern of a modification of the knitted selvedge (the weave shown in FIG. 4 is similar to the weave taught in U.S. Pat. No. 4,202,381)

Type of knitted selvedge:

The loops 3 were formed with the loop thread (knitted selvedge thread) 22 and the weft threads were held by the loops 3. The loop thread was reinforced by the intertwining (or catch) thread 23 as a fraying stopper, thereby forming the knitted selvedge (see, FIG. 5).

In the above examples, the warp threads having the lower denier size, higher elongation and smaller heat shrinkage percentage than the warp threads in the main part 1 were employed in both knitted selvedge 2 and woven selvedge 2'. It should however be noted that a webbing having good feeling to the touch and little fluffing tendency can be obtained when warp threads having lower denier size, higher elongation and smaller heat shrinkage percentage than the warp threads in the main part 1 are used for at least one of the selvedges.

Since the warp threads in the selvedge are finer than the warp threads in the main part and their denier size decreases toward the outermost warp threads in the selvedge, outer warp threads are woven with greater crimp percentage owing to the tensile force of the weft threads.

In conventional webbings, selvedge threads have a relatively large denier size, namely, are as large as 1,000 denier to 1,500 denier in diameter when polyester threads are used by way of example. Accordingly, the loops of the weft threads in the knitted selvedge and the turned end portions of the weft threads in the woven selvedge are indented or jagged significantly. Such unevenness can however be eliminated substantially by the present invention, since the warp threads in at least one of the selvedges are fine in diameter.

When the webbing of this invention is treated at an elevated temperature upon its dyeing, the warp threads in the selvedges do not undergo any unnecessary shrinkage because they are low-shrink threads. However, the weft threads are caused to shrink in the selvedge threads and do not protrude from the selvedges because the weft threads are high-shrink threads.

When a knitted selvedge is formed with weft threads, the loops of the knitted selvedge have a large heat shrinkage percentage. Upon its dyeing, the loops become smaller and are hence maintained in close contact with the selvedge. Since the intertwining thread is also caused to shrink at this time, the intertwining thread does not interfere the size reduction of the loops.

Further, the warp threads in the selvedges are fine in diameter. The thickness of each of the selvedges is somewhat smaller than that of the main part. Therefore, the selvedges are less affected than the main part when the webbing is bent and abraded by guides.

Having now fully described the invention, it will be apparent to one of ordinary skill in the art that many changes and modifications can be made thereto without departing from the spirit or scope of the invention as set forth herein.

I claim:

1. In a webbing for a safety belt, said webbing comprising a main part and selvedges extending along both sides of the main part, the improvement wherein the denier size of warp threads in at least one of the selvedges is smaller than the denier size of warp threads in the main part and decreases stepwise toward the outermost warp thread in said at least one selvedge, the outermost warp thread has a denier size at most equal to the denier size of weft threads, and the weft threads are made of threads having a higher heat shrinkage percentage than the warp threads in the main part.

2. The webbing as claimed in claim 1, wherein the elongation at break of the warp threads in said at least one selvedge is at least equal to that of the warp threads in the main part and the heat shrinkage percentage of the warp threads in said at least one selvedge is at most equal to that of the warp threads in the main part.

3. The webbing as claimed in claim 1, wherein the filaments forming the warp threads in said at least one selvedge are synthetic filaments having a denier size of from 8 to 14 denier.

4. The webbing as claimed in claim 1, wherein at least two outermost warp threads in the main part adjacent to said at least one selvedge extend adjacent to each other and form a 2-up/2-down weave.

5. The webbing as claimed in claim 1, wherein a first unit of warp threads in said at least one selvedge extending immediately adjacent to the main part is made of four threads formed in a 2-up/2-down weave; a second unit of warp threads in said at least one selvedge extending adjacent to said first unit of warp threads and outward from the main part is made of four threads having a denier size smaller than the threads of the first unit of warp threads and are formed in a 2-up/2-down weave; and a third unit of warp threads in said at least one selvedge extending adjacent to said second unit of warp threads and outward from the main part, is made of four threads having a denier size smaller than the threads of the second unit of warp threads and are formed in a 2-up/2-down weave.

6. The webbing as claimed in claim 1, wherein said at least one selvedge further comprises end loops, which are formed of the weft threads, and catch thread as a fraying stopper for the loops.

7. The webbing as claimed in claim 6, wherein the heat shrinkage percentage of the catch thread is greater than that of the warp threads in the main part.

8. The webbing as claimed in claim 1, wherein said at least one selvedge further comprises end loops formed of the weft threads, a knitting selvedge thread extending through the end loops of the weft threads and forming additional loops, and a catch thread as a fraying stopper for the knitting selvedge thread.

9. The webbing as claimed in claim 8, wherein the heat shrinkage percentages of the knitting selvedge thread and catch thread are greater than the heat shrinkage percentage of the warp threads in the main part.

10. The webbing as claimed in claim 1, wherein the outermost warp thread in said at least one selvedge is a twisted thread.

* * * * *